United States Patent [19]

Parker et al.

[11] 3,978,664

[45] Sept. 7, 1976

[54] GAS TURBINE ENGINE DIFFUSER

[75] Inventors: Robert W. Parker, Tolland; Bertus Ooms, Coventry, both of Conn.

[73] Assignee: United Technologies Corporation, Hartford, Conn.

[22] Filed: Sept. 29, 1975

[21] Appl. No.: 617,922

Related U.S. Application Data

[63] Continuation of Ser. No. 534,619, Dec. 20, 1974, abandoned.

[52] U.S. Cl. ..... 60/39.69; 415/210; 415/218

[51] Int. Cl.[2] ..... F02C 7/20

[58] Field of Search ..... 60/39.65, 39.66, 39.31, 60/39.32, 39.36, 39.69; 415/210, 217, 218

[56] References Cited

UNITED STATES PATENTS

| | | | |
|---|---|---|---|
| 2,577,918 | 12/1951 | Rowe | 60/39.65 |
| 2,614,385 | 10/1952 | Feilden | 60/39.65 |
| 2,699,040 | 1/1955 | Gaubatz | 60/39.65 |
| 2,711,072 | 6/1955 | Wetzler | 60/39.65 |
| 2,720,080 | 10/1955 | Oulianoff | 60/39.36 |
| 2,852,914 | 9/1958 | Robin et al. | 60/39.65 |
| 3,364,678 | 1/1968 | Alford | 60/39.66 |

FOREIGN PATENTS OR APPLICATIONS

| | | | |
|---|---|---|---|
| 621,438 | 4/1949 | United Kingdom | 60/39.65 |

*Primary Examiner*—Carlton R. Croyle
*Assistant Examiner*—Robert E. Garrett
*Attorney, Agent, or Firm*—Robert C. Walker

[57] ABSTRACT

Apparatus for diffusing the working medium gases which flow from the compression section of a gas turbine engine is disclosed. A controlled diffuser comprising an inner and an outer flow path shroud initially increases the static pressure and decreases the velocity of the medium gases flowing therebetween. The diffusion process is completed downstream of the flow path shrouds in a dump region of rapidly increasing flow area. The inner and outer shrouds of the controlled diffuser are concentrically supported at both the upstream and downstream ends. The inner and outer shrouds support the compressor exit vanes within the path of working medium gases flowing from the compressor and damp vane vibration during operation of the engine.

9 Claims, 3 Drawing Figures

FIG. 2
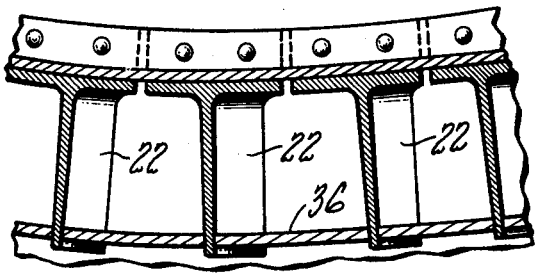
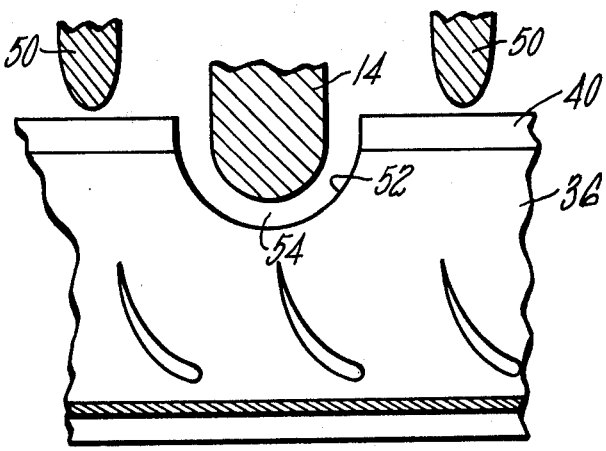
FIG. 3

GAS TURBINE ENGINE DIFFUSER

This is a continuation of application Ser. No. 534,619, filed Dec. 20, 1974, now abandoned.

BACKGROUND OF THE INVENTION

1. Field of the Invention

This invention relates to gas turbine engines and more specifically to the diffuser which is located between the combustion and the compression sections of axial flow engines.

2. Description of the Prior Art

An axial flow gas turbine engine principally comprises a compression section, a combustion section and a turbine section. Gases compressed within the compression section are flowed axially downstream to the combustion section where a port ion of the working medium gases is mixed with fuel in a combustion chamber to form a combustable mixture which is burned to increase the kinetic energy of the flowing gases.

A diffuser is interposed in the flow path of medium gases between the compression and the combustion sections to decrease the velocity and increase the static pressure of the flowing gases. Low velocity gases are preferred within the combustion section to prevent the accumulation of substantial flow losses as the medium is driven through the various passages and apertures within the combustion section.

An axial flow engine having a conventional diffuser section is shown in U.S. Pat. No. 2,686,401 to Newcomb. As is shown in FIG. 1 of Newcomb a diverging annular passage extends between the compression and the combustion section and forms a gas diffuser having a flow path area which increases gradually in the downstream direction from the compression section to the combustion section. In order to fully recover the static pressure of the flowing gases in a diffusion process the length of the diffusing element must be substantial. Increasing the angle of divergence between the diffuser walls increases the rate of diffusion. However, when the angle becomes excessive, the flow separates from the walls and substantial flow losses result. U.S. Pat. No. 3,300,121 to Johnson shows a diffuser section having rapidly diverging walls to shorten the axial length of the diffuser section. In Johnson additional upstream apparatus is provided for flowing compressed gases to the region of separation to reduce the flow losses.

The static pressure of the flowing medium gases is principally recovered during the initial portion of the diffusion process. Accordingly, a diffuser section having a shortened axial length can be provided where the initial diffusion is accomplished in a highly controlled diffusion element and the remaining diffusion accomplished in a diffuser dump region where the static pressure instantaneously increases and the flow velocity instantaneously decreases. An example of such apparatus is shown in U.S. Pat. No. 3,742,706 to Klompas. In all diffusion apparatus it is extremely important that regions of unstable pressure not be generated within the flowing medium gases. Any nonuniform pressure regions will be carried downstream by the flowing medium to the combustion section where they detrimentally effect uniform burning within the combustion chamber which subsequently precipitates uneven temperature zones within the turbine section. Uneven temperature zones limit the life of turbine components and are to be avoided where possible. To eliminate flow instability engine designers strive to provide diffuser sections which have concnetric inner and outer walls. Concentric apparatus which is initially provided must be held in concentric alignment when exposed to the severe thermal environment of th operating engine.

Continuing efforts are underway to provide efficient gas diffusion apparatus having a reduced axial length which is capable of increasing the static pressure and reducing the velocity of working medium gases flowing to the combustion section without inducing instability regions in the flowing medium.

SUMMARY OF THE INVENTION

A primary object of the present invention is to improve the durability of turbine components downstream of the combustion section without excessively increasing their cost and weight.

In conjunction with the primary object, one specific object is to improve the flow stability of working medium gases flowing to the combustion section of the engine. Concomitantly, a further object is to provide an easily modifiable diffuser.

In accordance with the present invention an inner flow path shroud is joined to the radially inward ends of a plurality of exit vanes which are circumferentially disposed within the path of working medium gases flowing from the compressor of a gas turbine engine and an outer flow path shroud is joined to the radially outward ends of said stator vanes, both shrouds extending axially downstream toward the combustion section of the engine to form a diverging flow path therebetween for diffusing the working medium gases to a lower velocity and an increased static pressure during operation of the engine.

An important feature of the present invention is the inner and outer flow path shrouds which extend in an axially downstream direction from the exit vanes toward the combustion section to diffuse the working medium gases passing therethrough to a lower velocity and an increased static pressure during the operation of the engine. In one embodiment the inner and outer flow path shrouds terminate at the same axial position along the flow path of the working medium gases. In another embodiment a mechanical attaching means which joins the inner shroud to the inner wall of the diffusion section partially damps the vibrationally excited vanes during operation of the engine. Additionally, support pads on the outer wall oppose a support surface of the downstream end of the outer flow path shroud to provide radial restraint and to maintain the shroud in a concentric relationship to the outer wall; the inner flow path shroud is held concentric to the inner wall by attaching means at the downstream end of the inner shroud.

A primary advantage of the present invention is the controlled diffusion of the working medium gases between the inner and outer shrouds which prevents regions of unstable pressure from being generated in the diffuser. Stable airflow emission from the diffuser is essential to even burning within the downstream combustion chamber. Additionally, a streamlined flow path is provided through the diffusion section without flow path discontinuities between the stator vanes and the diffusion section of the engine. The controlled diffuser has a relatively short axial length and, in conjunction with a dump region downstream of the shrouds, provides an efficient engine diffuser which is consistent with cost and weight objectives.

The foregoing, and other objects, features and advantages of the present invention will become more apparent in the light of the following detailed description of the preferred embodiment thereof as shown in the accompanying drawing.

BRIEF DESCRIPTION OF THE DRAWING

FIG. 2 is a section view taken along the line 2—2 as shown in FIG. 1; and

FIG. 3 is a section view taken along the line 3—3 as shown in FIG. 1.

DESCRIPTION OF THE PREFERRED EMBODIMENT

Figure 1:
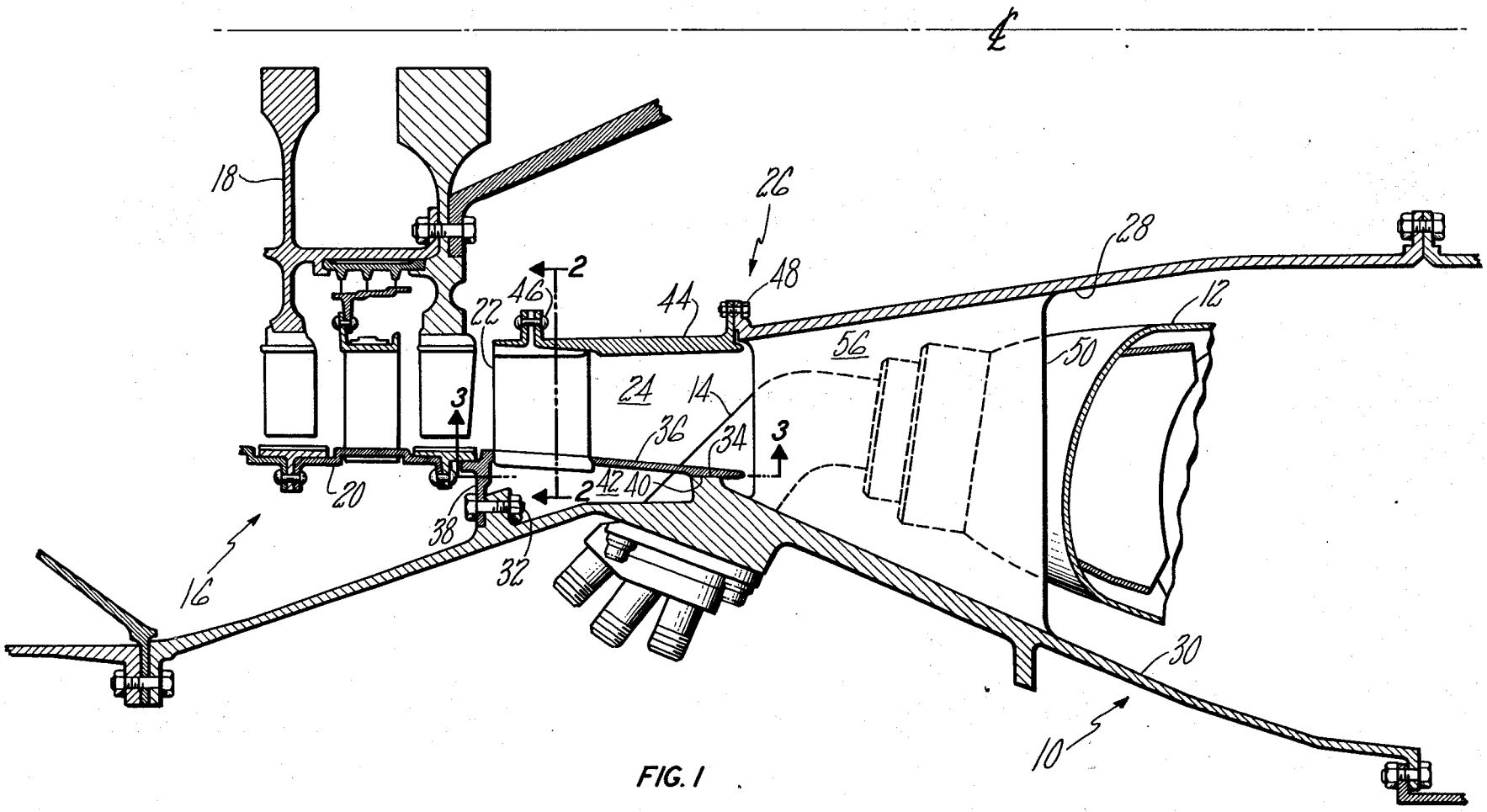
FIG. 1 is a cross-sectional view of a portion of an axial flow gas turbine engine showing a diffusion section upstream of the engine combustion chamber in accordance with the present invention.

A portion of an axial flow gas turbine engine is shown in FIG. 1. A combustion section 10 including one or more combustion chambers 12 and one or more fuel nozzles 14 is positioned axially downstream from a compressor section 16 which includes a rotor assembly 18 and a stator assembly 20. The stator assembly includes a compressor exit vane 22. Although only one compressor exit vane is shown in FIG. 1 a multiplicity of the exit vanes are circumferentially disposed at the same axial location within an annular flow path 24 leading from the compression section. A diffusion section 26 is interposed axially between the compression and the combustion sections. The diffusion section includes an inner wall 28 and outer wall 30 which radially enclose the forward portion of the combustion chamber 12. The outer wall has a mounting flange 32 and one or more support pads 34. The diffuser section further includes an outer flow path shroud 36 having a case mounting flange 38 which is joined to the mounting flange 32 of the outer wall and a support surface 40 which engages the corresponding support pad 34 of the outer wall. A plenum chamber 42 is formed between the outer flow path shroud and the outer wall. An inner flow path shroud 44 is joined to the exit vane 22 by means such as one or more rivets 46 and to the inner wall 28 by bolts 48. A radially extending strut 50 joins the inner wall 28 structurally to the outer wall 30. Although only one strut is shown in FIG. 1 a plurality of struts are circumferentially disposed within the flow path 24.

As is shown in FIG. 2 each compressor exit vane 22 penetrates the outer annular shroud 36. The outer flow path shroud has a cut out portion 52 at each fuel nozzle location to accommodate the fuel nozzle 14 as is shown in FIG. 3. A space 54 between the cut out portion 52 of the outer flow path shroud 36 and a fuel nozzle 14 provides gas communication between the flow path 24 and the plenum chamber 42 shown in FIG. 1.

During operation of the engine working medium gases are compressed within the compressor section 16 and flowed axially downstream through the flow path 24 to the combustion section 10. Disposed between the compression and combustion section is the diffusion section 26 which principally comprises the outer flow path shroud 36 and the inner flow path shroud 44. The inner and outer flow path shrouds diverge to form a controlled gas diffuser which decreases the velocity and increases the static pressure of the working medium gases flowing therethrough. The diffusion process is completed axially downstream of the inner and outer shrouds in a dump region 56 wherein the velocity of the working medium gases is further decreased and the pressure of the gases further increased. Although the static pressure of the flowing gases is recovered throughout the entire length of the diffuser section including the dump region, the principal amount of pressure is recovered within the controlled diffuser formed by the inner and outer flow path shrouds.

Diffusion of the working medium gases prior to entering the combustion section reduces the medium flow losses in the combustion chamber and desirably stabilizes the flow to promote even burning of the combustion products. The principal region of controlled diffusion lies between the inner and outer shrouds where the effects of local thermal conditions tending to distort the inner and outer shrouds are minimized by concentrically supporting the shrouds at both the upstream and downstream ends. The supported diffuser has a uniform cross section and is free of the local instability regions accompanying diffusers which have thermally distorted shrouds. The controlled diffusion region is also free from penetrating struts which in prior constructions have induced instability regions in the medium flow path. Unstable flow which is carried downstream into the combustion section produces erratic burning in the combustion chamber 12 and results in nonuniform temperature distributions at the inlet to the turbine section of the engine. The turbine section already experiences the most hostile of engine environment conditions and stability improvements within the combustion section directly and significantly improve the entire engine life. Accordingly, the present invention not only improves the local diffusion process but beneficially effects the entire downstream operation of the engine.

The combination of a short controlled diffusion section and a dump diffuser region provides efficient diffusion apparatus in a manner which is consistent with weight and cost objectives. Between the inner and outer shrouds the angle of divergence is small and the diffusion process is quite efficient. In the dump region diffusion is instantaneously completed from the intermediate pressure and velocity at the exit from the controlled diffuser. Although, diffusion at the dump region is not as efficient as in the controlled diffuser it is nonetheless uniform and is accomplished without the excessive cost and weight required to diffuse completely within a controlled diffuser. In the embodiment shown both the inner and outer shrouds are terminated at the same downstream axial position relative to the flow path of the medium gases. Cotermination prevents radial turning of the flow in the direction of a prior terminated shroud. It should be noted, however, that pretermination of the inner or outer shroud may be desirable in engine configurations where the flow path of the medium gases is to be turned in a radially inward or radially outward direction as the gases approach the combustion section.

The exit vanes 22 are mechanically attached to the inner shroud 44 by rivet means 46. The mechanical attachment of the vanes to the inner shroud at this location desirably friction damps the vanes when the vanes are vibrationally excited during operation of the engine. In one embodiment the radially outboard end of the vanes is joined to the outer flow path shroud by brazing although other suitable attaching means may be utilized. The exit vanes 22 concentrically position the upstream ends of the inner shroud 44 and the outer shroud 36 relative to each other.

As is seen in FIG. 1 the downstream ends of the inner shroud 44 and the outer shroud 36 are concentrically positioned initially and are subsequently restrained in the installed position under all thermal conditions by the inner wall 28 and the outer wall 30 of the diffusion section 26. The inner and the outer wall are spaced apart by the plurality of struts 50 and comprise a massive structure which is relatively insensitive to local thermal conditions when compared to the outer and inner flow path shrouds. The outer shroud 36 is supported at its downstream end and concentrically restrained by support pads 34 extending from the outer wall 30. Similarly, the inner shroud 44 is concentrically restrained at its downstream end by the inner wall 28 through the bolting means 48.

Although in the FIG. 1 embodiment the inner flow path shroud is bolted to the inner wall of the diffuser section, it should be recognized by one skilled in the art that attachment to the inner wall by welding is also suitable and provides an assembly having reduced weight and cost. Bolt attaching means have been utilized in the embodiment shown to facilitate replacement of the controlled diffuser section. During the development and improvement of a specific gas turbine engine it is commonly necessary to alter the geometry of the diffuser section in response to changes in downstream components such as combustion chambers or to accommodate increased medium flow as the engine thrust is upgraded.

In the diffuser section shown the inner and outer shroud extends from the upstream portion of the exit vane 22 along the entire length of the controlled diffusion section to provide a diffuser which is free of flow discontinuities along the flow path wall. Additionally, the plenum chamber 42 is supplied with compressor air which flows through the gap 54 downstream of the controlled diffusion region between the outer flow path shroud 36 and the fuel nozzle 14. Air bled from the plenum chamber 42 is conventionally utilized to operate or supply aircraft support systems. Although the invention has been shown and described with respect to preferred embodiments thereof, it should be understood by those skilled in the art that various changes and omissions in the form and detail thereof may be made therein without departing from the spirit and the scope of the invention.

Having thus described a typical embodiment of our invention, that which we claim as new and desire to secure by Letters Patent of the United States is:

1. In a gas turbine engine having a compression section which includes a plurality of exit vanes circumferentially disposed within the path of working medium gases flowing from the compression section and having a diffusion section downstream of the compression section which includes an inner wall and an outer wall which are joined by a plurality of radially oriented struts extending between the inner and outer walls, apparatus for diffusing the working medium gases which flow from the compression section to the combustion section during operation of the engine, comprising:

an inner flow path shroud having an upstream end which is joined to the exit vanes of the compression section and a downstream end which is located radially outboard of and joined to the inner wall of the diffusion section; and an outer flow path shroud having an upstream end which is attached to the exit guide vanes of the compression section and a downstream end which engages the outer wall of the diffusion section, the inner and outer shrouds forming a controlled diffuser upstream of said struts which is free of protuberances in at least the predominant axial portion thereof.

2. The invention according to claim 1 wherein the inner and outer shrouds terminate at the same downstream axial position with respect to the path of working medium gases.

3. The invention according to claim 1 wherein the inner and outer shrouds extend into the combustion section of the engine.

4. The invention according to claim 1 wherein the outer wall has one or more support pads facing in a radially inward direction and the outer flow path shroud has a support surface which faces radially outward and engages one or more of the support pads of the outer annular wall.

5. In a gas turbine engine having a compression section and a combustion section, a diffusion section which is disposed between the compression and combustion sections and which comprises:

an inner annular wall;

an outer annular wall having one or more support pads facing in a radially inward direction;

a plurality of radially extending struts which join the inner wall to the outer wall;

an inner flow path shroud joined to the inner annular wall and extending in an upstream axial direction toward the compressor section of the engine;

a plurality of stator vanes attached to and extending radially outward from the inner annular shroud; and an outer flow path shroud joined to the outer ends of the plurality of stator vanes and extending axially downstream to the outer wall of the combustion section and having a support surface which faces radially outward to engage one or more of the support pads of the outer annular wall, wherein the inner and outer shrouds form a controlled diffuser upstream of said struts which is free of protuberances in at least the predominant axial portion thereof.

6. The invention according to claim 5 wherein said plurality of stator vanes are attached to said inner annular shroud by mechanical attaching means.

7. The invention according to claim 6 wherein said mechanical attaching means are rivets.

8. The invention according to claim 1 wherein the controlled diffuser is mechanically detachable from the diffusion section.

9. The invention according to claim 1 wherein the inner and outer walls of the diffusion section define downstream of the controlled diffuser a dump diffuser region into which the medium gases are flowed prior to distribution about the combustion section.

* * * * *